US006447641B1

(12) United States Patent
Wolkowicz et al.

(10) Patent No.: US 6,447,641 B1
(45) Date of Patent: Sep. 10, 2002

(54) TRANSFER SYSTEM AND PROCESS FOR MAKING A STRETCHABLE FIBROUS WEB AND ARTICLE PRODUCED THEREOF

(75) Inventors: Richard Ignatius Wolkowicz, Cumming; Kenneth Kaufman, Alpharetta, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 08/969,880

(22) Filed: Nov. 14, 1997

Related U.S. Application Data

(63) Continuation-in-part of application No. 08/751,526, filed on Nov. 15, 1996, now Pat. No. 5,725,734.

(51) Int. Cl.[7] ..... D21H 11/00

(52) U.S. Cl. ..... 162/109; 162/100; 162/111; 162/117; 162/123; 162/158; 162/181.1; 428/537.5

(58) Field of Search ..... 162/109, 111, 162/196, 197, 201, 202, 123, 117, 115, 181.1–181.8, 183, 146, 157.1–157.3, 157.6, 157.7, 149, 158, 129, 177, 100, 104, 105, 107; 428/537.5, 311.5, 371.71, 311.91

(56) References Cited

U.S. PATENT DOCUMENTS

| | | | | | |
|---|---|---|---|---|---|
| 2,494,334 | A | * | 1/1950 | Dorst | 162/111 |
| 3,320,119 | A | | 5/1967 | Erbach | 162/306 |
| 3,441,476 | A | | 4/1969 | Schiel | 162/306 |
| 3,454,463 | A | * | 7/1969 | Welsh | 162/111 |
| 3,476,644 | A | * | 11/1969 | Krehnbrink | 162/111 |
| 3,523,865 | A | | 8/1970 | Ihrman | 162/111 |
| 3,537,955 | A | | 11/1970 | Huerta et al. | 162/306 |
| 3,564,677 | A | | 2/1971 | Kalwaites | 28/1 |
| 3,598,697 | A | | 8/1971 | McKie et al. | 162/306 |
| 3,622,451 | A | | 11/1971 | Roecker | 162/374 |
| 4,072,557 | A | | 2/1978 | Schiel | 162/111 |
| 4,073,679 | A | | 2/1978 | Schiel | 162/306 |
| 4,102,737 | A | | 7/1978 | Morton | 162/113 |
| 4,113,557 | A | | 9/1978 | Kankaanpaa | 162/301 |
| 4,125,659 | A | | 11/1978 | Klowak et al. | 428/153 |
| 4,158,594 | A | * | 6/1979 | Becker et al. | 162/112 |
| 4,191,609 | A | | 3/1980 | Trokhan | 162/113 |
| 4,192,711 | A | | 3/1980 | Tapio et al. | 162/199 |
| 4,196,044 | A | * | 4/1980 | Mussoni et al. | 162/112 |
| 4,224,104 | A | | 9/1980 | Kankaanpaa | 162/205 |
| 4,234,382 | A | | 11/1980 | Schiel | 162/263 |
| 4,236,962 | A | | 12/1980 | Kankaanpaa | 162/204 |
| 4,243,482 | A | | 1/1981 | Seppanen | 162/202 |
| 4,356,059 | A | | 10/1982 | Hostetler | 162/111 |
| 4,432,927 | A | | 2/1984 | van Tilburg et al. | 264/282 |
| 4,440,597 | A | | 4/1984 | Wells et al. | 162/111 |
| 4,551,199 | A | | 11/1985 | Weldon | 162/109 |
| 4,834,838 | A | | 5/1989 | Klowak | 162/109 |
| 4,849,054 | A | | 7/1989 | Klowak | 162/109 |
| 4,875,976 | A | | 10/1989 | Wedel | 162/306 |
| 4,921,575 | A | | 5/1990 | Page | 162/306 |
| 4,964,956 | A | | 10/1990 | Lamminen et al. | 162/203 |
| 5,048,589 | A | | 9/1991 | Cook et al. | 162/109 |
| 5,223,092 | A | | 6/1993 | Grinnell et al. | 162/109 |
| 5,238,535 | A | | 8/1993 | Kraft | 162/193 |
| 5,314,584 | A | | 5/1994 | Grinnell et al. | 162/109 |
| 5,320,713 | A | | 6/1994 | Bubik et al. | 162/203 |
| 5,336,373 | A | | 8/1994 | Scattolino et al. | 162/116 |
| 5,399,412 | A | | 3/1995 | Sudall et al. | 428/153 |

FOREIGN PATENT DOCUMENTS

| | | |
|---|---|---|
| CA | 556282 | 4/1958 |
| CA | 573611 | 4/1959 |
| CA | 579490 | 7/1959 |
| CA | 670309 | 9/1963 |
| DE | 42 24 729 | 11/1992 |
| EP | 0 617 164 | 9/1994 |
| EP | 0 631 014 | 12/1994 |
| GB | 810707 | 3/1959 |
| GB | 825924 | 12/1959 |
| GB | 1 212 473 | 11/1970 |

OTHER PUBLICATIONS

Japanese Patent Publication No. 26137/67, Publication Date Dec. 12, 1967.

* cited by examiner

*Primary Examiner*—Jose Fortuna
(74) *Attorney, Agent, or Firm*—Dority & Manning, P.A.

(57) ABSTRACT

The present invention encompasses a machine direction extensible noncalendered fibrous web produced by a transfer system of at least eight percent negative draw including a matrix of fibrous web material having a wet mullen burst at least about 10 percent greater than a convex transfer system produced web. In addition, the matrix of fibrous material has a wet mullen burst of at least about 74500 pascals. Moreover, the matrix of fibrous web material has a GMBL ranging from about 2047 to about 2704. Furthermore, the matrix of fibrous web material includes fibers, which may be selected from the group consisting of a bonded carded web, spunbonded web, meltblown fiber web, and multi-ply fibrous web. Moreover, the matrix of fibrous web material may have an elmendorf tear greater than about 66.5 centinewton. Also, the matrix of fibrous web material may have a tensile modulus of at least about 1544 gram per centimeter squared. Additionally, the matrix of fibrous web material may have greater strength at lower negative draw percent. Furthermore, the matrix of fibrous web material may have a greater machine direction toughness at about the same GMBL as a convex transfer produced web.

20 Claims, 10 Drawing Sheets

TRANSFER SYSTEM AND PROCESS FOR MAKING A STRETCHABLE FIBROUS WEB AND ARTICLE PRODUCED THEREOF

CROSS REFERENCE TO RELATED APPLICATIONS

This application is a continuation-in-part of U.S. patent application Ser. No. 08/751,526, filed Nov. 15, 1996 now U.S. Pat. No. 5,725,734.

FIELD OF THE INVENTION

This invention generally relates to the field of paper making, and more specifically, to a fibrous web produced by a transfer system.

BACKGROUND

In a paper making machine, paper stock is fed onto traveling endless belts or "fabrics" that are supported and driven by rolls. These fabrics serve as the papermaking surface of the machine. In many paper making machines, at least two types of fabrics are used: one or more "forming" fabrics that receive wet paper stock from a headbox or headboxes, and a "dryer" fabric that receives the web from the forming fabric and moves the web through one or more drying stations, which may be through dryers, can dryers, capillary dewatering dryers or the like. In some machines, a separate transfer fabric may be used to carry the newly formed paper web from the forming fabric to the dryer fabric.

Generally speaking, the term "first transfer" refers to the transfer of the wet paper stock from a headbox to the forming fabric, which will be referred to as the "first carrier fabric". The term "second transfer" may be understood as the transfer of the paper web that is formed on the first carrier fabric to a transfer fabric or a dryer fabric, which will be referred to as a "second carrier fabric". These terms may be used in connection with twin wire forming machines, Fourdrinier machines and the like.

At or near the second transfer, the first carrier fabric and the second carrier fabric are guided to converge so that the paper web is positioned between the two fabrics. Generally speaking, centripetal acceleration, centrifugal acceleration and/or air pressure (which is typically applied as either a positive pressure or a negative pressure from a "transfer head" that is adjacent to the fabrics) causes the web to separate from the forming fabric and attach to the dryer fabric.

While the second carrier fabric is often run at the same speed as the first carrier fabric, it is known that the second carrier fabric may be run at a speed that is less than the speed of the first carrier fabric. This difference in speed between the fabrics is typically expressed in terms of a ratio of fabric velocities (i.e., velocity ratio) to describe what is known in the industry as "negative draw." As described in U.S. Pat. No. 4,440,597, to Wells et al., the speed differential between the fabrics in the region of the second transfer bunches the web and creates microfolds that enhance the web's bulk and absorbency. This increases the bulk and absorbency of the web, and also increases stretch or extensibility in the machine direction (MD) of the web. Too much negative draw, however, will create undesirable "macrofolding" in which part of the web buckles and folds back on itself. FIG. 1 depicts a cross-sectional representation (not to scale) of an exemplary macrofold in a paper sheet. Generally speaking, macrofolds occur in such a manner that adjacent machine direction spaced portions of the web become stacked on each other in the Z-direction of the web. The risk of macrofolding appears to impose a limitation on the amount of negative draw (i.e., the velocity ratio) that can be applied at the second transfer.

Generally speaking, it has been thought that the amount of MD foreshortening and subsequent extensibility (i.e., MD stretch) imparted to the web at the second transfer is very closely proportional to or essentially the same as the velocity ratio of the second carrier fabric to that of the first carrier fabric. Thus, attempts to increase the MD stretch or foreshortening of a web by increasing the velocity ratio (i.e., negative draw) were thought to also increase the likelihood of macrofolding.

Accordingly, a need exists for an improved process of making a fibrous web with desirable machine direction stretchability while avoiding macrofolding. For example, such a need extends to a process of making a paper web with desirable machine direction stretch while avoiding macrofolding.

There is also a need for an improved second transfer system for use in a paper making machine that allows greater MD extensibility (i.e., MD stretch) to be achieved at the same, or even lower, levels of negative draw than heretofore thought possible. Meeting this need is important because it is highly desirable to achieve greater MD extensibility (i.e., MD stretch) at the same, or even lower, levels of negative draw. It is also highly desirable to achieve even the same amount of MD extensibility (i.e., MD stretch) at lower levels of negative draw. Meeting this need would provide the positive benefits of creating MD-oriented extensibility or stretch in the web while avoiding or lowering the risk of macrofolding. Meeting this need could also allow more MD-oriented extensibility or stretch to be built into the web without increasing the risk of macrofolding.

Furthermore, webs produced by a conventional transfer process using a convex transfer head surface, for example the process described in U.S. Pat. No. 4,440,597, and issued Apr. 3, 1984, may lack sufficient toughness, particularly when wet. Generally, a towel incorporating a web produced by a transfer process with improved toughness provides more durability during scrubbing. In addition, a transfer process produced web with improved toughness may resist deformation and breaking during processing, thereby improving manufacturing efficiencies. Generally moreover, improved toughness permits manufacture of a towel with less strength, but with comparable toughness of a conventional towel. Generally, lowering the strength requirements permits the manufacture of a towel with a softer feel.

Accordingly, a web that is manufactured by a transfer process and has greater toughness will improve over conventional webs.

DEFINITIONS

As used herein, the term "nonwoven web" refers to a web that has a structure of individual fibers or filaments which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "spunbonded web" refers to a web of small diameter fibers and/or filaments which are formed by extruding a molten thermoplastic material as filaments from a plurality of fine, usually circular, capillaries in a spinnerette with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" means small diameter fibers having an average diameter not greater than about 100 microns, for example, having a diameter of from about 0.5 microns to about 50 microns, more specifically microfibers may also have an average diameter of from about 1 micron to about 20 microns. Microfibers having an average diameter of about 3 microns or less are commonly referred to as ultra-fine microfibers. A description of an exemplary process of making ultra-fine microfibers may be found in, for example, U.S. Pat. No. 5,213,881, entitled "A Nonwoven Web With Improved Barrier Properties".

As used herein, the term "fibrous cellulosic material" refers to a nonwoven web including cellulosic fibers (e.g., pulp) that has a structure of individual fibers which are interlaid, but not in an identifiable repeating manner. Such webs have been, in the past, formed by a variety of nonwoven manufacturing processes known to those skilled in the art such as, for example, air-forming, wet-forming and/or paper-making processes. Exemplary fibrous cellulosic materials include papers, tissues and the like. Such materials can be treated to impart desired properties utilizing processes such as, for example, calendering, creping, hydraulic needling, hydraulic entangling and the like. Generally speaking, the fibrous cellulosic material may be prepared from cellulose fibers from synthetic sources or sources such as woody and non-woody plants. Woody plants include, for example, deciduous and coniferous trees. Non-woody plants include, for example, cotton, flax, esparto grass, milkweed, straw, jute, hemp, and bagasse. The cellulose fibers may be modified by various treatments such as, for example, thermal, chemical and/or mechanical treatments. It is contemplated that reconstituted and/or synthetic cellulose fibers may be used and/or blended with other cellulose fibers of the fibrous cellulosic material. Fibrous cellulosic materials may also be composite materials containing cellulosic fibers and one or more non-cellulosic fibers and/or filaments. A description of a fibrous cellulosic composite material may be found in, for example, U.S. Pat. No. 5,284,703.

As used herein, the term "pulp" refers to cellulosic fibrous material from sources such as woody and non-woody plants. Woody plants include, for example, deciduous and coniferous trees. Non-woody plants include, for example, cotton, flax, esparto grass, milkweed, straw, jute, hemp, and bagasse. Pulp may be modified by various treatments such as, for example, thermal, chemical and/or mechanical treatments.

As used herein, the term "machine direction" (hereinafter may be referred to as "MD") is the direction of a material parallel to its forward direction during processing.

As used herein, the term "cross direction" (hereinafter may be referred to as "CD") is the direction of a material perpendicular to its machine direction.

As used herein, the term "machine direction tensile" (hereinafter may be referred to as "MDT") is the force per machine direction unit width required to rupture a sample and may be reported as kilogram-force per meter.

As used herein, the term "cross direction tensile" (hereinafter may be referred to as "CDT") is the force per cross direction unit width required to rupture a sample and may be reported as kilogram-force per meter.

As used herein, the term "basis weight" (hereinafter may be referred to as "BW") is the weight per unit area of a sample and may be reported as kilogram-force per meter squared.

As used herein, the term "geometric mean breaking length" (hereinafter may be referred to as "GMBL") is the measurement of the strength of a material, generally a fabric or nonwoven web, and may be reported in length measurements, such as meters. The greater the geometric mean breaking length generally relates to a stronger material. The geometric mean breaking length is calculated by the formula:

$$GMBL=(MDT*CDT)^{0.5}/BW$$

As used herein, the term "peak energy" is the measurement the toughness of a material, generally a fabric or nonwoven web, and may be reported in static energy measurements, such as kilogram times meter times centimeter, which may be hereinafter be abbreviated as "cm-kgm". The peak energy is the area under the tensile load versus strain curve from the origin to the breaking point of the material.

As used herein, the term "wet mullen burst" is a test used to measure the overall toughness of a water saturated material, such as fabric or nonwoven web. The higher material rupture pressure, typically reported in pascals, generally relates to a tougher water saturated material.

As used herein, the term "dry mullen burst" is a test used to measure the overall toughness of a material, such as fabric or nonwoven web, treated approximately 12 hours at 23 degrees centigrade at 50 percent humidity prior to testing. The higher material rupture pressure, typically reported in pascals, generally relates to a tougher material.

As used herein, the term "gauge length" is the length of a sample, typically reported in centimeters, measured between the points of attachment while under uniform tension.

As used herein, the term "slack" is the lack of tension in a sample and reported in length measurements, such as millimeters.

As used herein, the term "percent stretch" is a test used to measure the toughness of a material, such as fabric or nonwoven web. The percent stretch is the increase in length expressed as a percentage of the corrected gauge length, which is gauge length plus slack. The higher percent stretch generally relates to a tougher material.

As used herein, the term "elmendorf tear" is a test used to measure the toughness of a material, such as fabric or nonwoven web. The test measures the force, typically reported in centinewtons, required to start or propagate a rip in a material. The higher required force generally relates to a tougher material.

As used herein, the term "tensile modulus" is the slope of the tensile load versus strain curve measured from the origin until the sample reaches its inelastic point. This measurement may be reported in units of force per area, such as gram-force per centimeter squared. The higher curve slope generally relates to a tougher sample.

As used herein, the term "calender" refers to a process for fabrics or nonwoven webs that reduces the caliper and imparts surface effects, such as increased gloss and smoothness. Generally, the process includes passing the fabric through two or more heavy rollers, sometimes heated, and under heavy pressure.

As used herein, the term "noncalender" refers to a fabric or nonwoven web that has not undergone a calender process.

As used herein, the terms "permeable" and "permeability" refer to the ability of a fluid, such as, for example, a gas to pass through a particular porous material. Permeability may be expressed in units of volume per unit time per unit area, for example, (cubic feet per minute) per square foot of material (e.g., (ft3/minute/ft2). Permeability was determined utilizing a Frazier Air Permeability Tester available from the Frazier Precision Instrument Company and measured in accordance with Federal Test Method 5450, Standard No. 191A, except that the sample size was 8"×8" instead of 7"×7". Although permeability is generally expressed as the ability of air or other gas to pass through a permeable sheet, sufficient levels of gas permeability may correspond to levels of liquid permeability to enable the practice of the present invention. For example, a sufficient level of gas permeability may allow an adequate level of liquid to pass through a permeable sheet with or without assistance of a driving force such as, for example, an applied vacuum or applied gas pressure.

SUMMARY OF THE INVENTION

Accordingly, it is an object of this invention to provide an improved process of making a fibrous web with desirable machine direction stretch while avoiding macrofolding.

It is also an object of this invention to provide a second transfer system for use in a paper making machine that allows greater machine direction stretch to be achieved at the same, or even lower, levels of negative draw than heretofore thought possible.

It is also an object of this invention to provide a fibrous cellulosic web having a relatively low density structure, good absorbency, good strength and relatively high levels of MD extensibility or stretch than heretofore thought possible without macrofolding.

These and other objects are addressed by the process of the present invention for making a machine direction extensible fibrous web utilizing an improved second transfer system having a lengthened transfer zone. The process includes the steps of: 1) forming a fibrous web from an liquid suspension of fibrous material, the fibrous web having a consistency ranging from about 12% to about 38% (after the headbox); 2) transporting the fibrous web on a first carrier fabric at a first velocity to a lengthened transfer zone that begins at a transfer shoe and terminates at a portion of a transfer head and has a machine direction oriented length ranging from about 0.75 inches to about 10 inches; 3) guiding the first carrier fabric and fibrous web over the transfer shoe so they converge at a first angle with a second carrier fabric moving along a linear path through the lengthened transfer zone at a second velocity which is less than the first velocity, wherein the first angle is sufficient to generate centrifugal force to aid transfer of the fibrous web to a second carrier fabric and wherein the first and second carrier fabrics begin diverging immediately after the transfer shoe at a second angle such that the distance between the first and second carrier fabrics through the lengthened transfer zone is approximately equal to the thickness of the fibrous web; 4) applying a sufficient level of gaseous pressure differential at the transfer head to complete the separation of the fibrous web from the first carrier fabric and attachment to the second carrier fabric; and 5) drying the fibrous web.

The fibrous web (e.g., paper sheets) produced by the process of the present invention has greater machine direction extensibility than fibrous webs (e.g., paper sheets) processed with the same carrier fabrics in differential speed transfer processes without the improved second transfer system having a lengthened transfer zone.

According to the invention, the fibrous web may have a consistency ranging from about 18% to about 30%. For example, the fibrous web may have a consistency ranging from about 20% to about 28%.

The lengthened transfer zone begins at a transfer shoe and terminates at a portion of a transfer head. Desirably, the lengthened transfer zone terminates at a leading or top edge of a vacuum slot in the transfer head. When measured between the transfer shoe land and the leading or top edge of a vacuum slot in the transfer head, the machine direction oriented length of the lengthened transfer zone may range from about 0.75 to about 10 inches. For example, the machine direction oriented length of the lengthened transfer zone may range from about 2 to about 5 inches. As another example, the machine direction oriented length of the lengthened transfer zone may range from about 3 to about 4 inches. As yet another example, the machine direction oriented length of the lengthened transfer zone may be about 3.5 inches. Of course, it is contemplated that the lengthened transfer zone having similar dimensions may terminate at other portions of the transfer head such as, for example, the trailing edge of the vacuum slot, the trailing edge of the transfer head or the like.

The first angle at the transfer shoe may range from about 2 degrees to about 20 degrees. For example, the first angle at the transfer shoe may range from about 8 degrees to about 12 degrees.

According to an aspect of the invention, the first and second carrier fabrics diverge immediately after the transfer shoe at a second angle ranging from about 0.01 degree to about 1 degree such that the distance between the first and second carrier fabrics through the lengthened transfer zone is approximately equal to the thickness of the fibrous web. For example, the second angle may range from about 0.075 degree to about 0.5 degree. As another example, the second angle may be about 0.1 degree. Generally speaking, the distance between the first and second carrier fabrics through the lengthened transfer zone may range from about 0.0075 inch to about 0.0125 inch for a paper sheet having a basis weight of about 32 grams per square meter (~1 ounce per square yard).

In an embodiment of the process of the present invention, the fibrous web may be a paper sheet including, but not limited to, paper towel, paper tissue, crepe wadding, paper napkin, or the like.

The process of the present invention may utilize any conventional drying technique. Desirably, the drying technique is a non-compressive drying technique. Exemplary drying techniques include, but are not limited to, Yankee dryers, heated cans, through-air dryers, infra-red dryers, heated ovens, microwave dryers and the like. The process of the present invention may also include any conventional post-treatment steps including, but not limited to, creping, double re-recreping, mechanical softening, embossing, printing or the like.

The present invention also encompasses a machine direction extensible fibrous web formed by the process described above.

An aspect of the present invention relates to an improved transfer configuration for a paper making machine that is designed to produce in a fibrous web, at any given amount of negative draw, a greater amount of machine direction-oriented extensibility or stretch than was heretofore thought possible. This improved transfer configuration includes first carrier fabric having a first surface on which a fibrous web is transported to the transfer configuration; a second carrier fabric having a second surface on which the fibrous web is transported away from the transfer configuration; and a lengthened transfer zone structure for constraining the first and second carrier fabrics to move through a substantially linear, lengthened transfer zone, the lengthened transfer zone defined as the area in which the first and second surfaces are separated by a distance that is approximately equal to the thickness of the fibrous web, and wherein the lengthened transfer zone structure further constrains the first and second carrier fabrics as to cause the transfer zone to have a machine direction oriented length that is within the range of about 1.5 inches to about ten inches, the lengthened transfer means having the ability to increase the amount of machine direction stretch or extensibility that is built into the fibrous web at any given level of negative draw.

Generally speaking, the distance between the first and second carrier fabrics within the transfer zone should be sufficient so that both the first carrier fabric and the second carrier fabric are in contact with the fibrous web.

An aspect of the improved transfer configuration of the present invention is that the first and second carrier fabrics are constrained so as to form a substantially linear, lengthened transfer zone. The second carrier fabric should pass through the lengthened transfer zone along a linear path. The first carrier fabric should also pass through the lengthened transfer zone along a linear path. The fabrics may diverge at a slight angle which may range from about 0.05 to about 0.125 degrees.

The present invention also encompasses a process of making a machine direction extensible or stretchable fibrous web in which the process includes the steps of (a) transporting a fibrous web on a first surface of a first carrier fabric to a transfer configuration; (b) moving a second carrier fabric that has a second surface to the transfer configuration, the second carrier fabric being moved at a speed that is less than the speed of the first carrier fabric to create an amount of negative draw; (c) constraining, at the transfer configuration, the first and second carrier fabrics to move through a lengthened transfer zone that is defined as the area in which the first and second surfaces are separated by a distance that is approximately equal to the thickness of the fibrous web, the transfer zone having a machine direction oriented length that is within the range of about 1.5 inches to about ten inches; and (d) transporting the foreshortened web away from the transfer configuration on the second surface of the second carrier fabric.

According to an aspect of the process described above, the distance between the first and second carrier fabrics within the transfer zone should be sufficient so that both the first carrier fabric and the second carrier fabric are in contact with the fibrous web.

A machine direction stretchable web made according to the transfer system or process discussed above is also considered to be an important aspect of the invention.

The present invention further encompasses a machine direction extensible noncalendered fibrous web produced by a transfer system of at least eight percent negative draw including a matrix of fibrous web material having a wet mullen burst pressure at least about 10 percent greater than a convex transfer system produced web. Moreover, the matrix of fibrous web material has a wet mullen burst of at least about 74500 pascals. In addition, the matrix of fibrous web material has a GMBL ranging from about 2047 to about 2704. Furthermore, the fibers of the fibrous web matrix may be generated from the group consisting of a bonded carded web, spunbonded web, meltblown fiber web, and multi-ply fibrous web. Moreover, the matrix of fibrous web material may have an elmendorf tear greater than about 66.5 centinewton. Also, the matrix of fibrous web material may have a tensile modulus of at least about 1544 gram per centimeter squared. Additionally, the matrix of fibrous web material may have greater strength at lower negative draw percent. Furthermore, the matrix of fibrous web material may have a greater machine direction toughness at about the same GMBL as a convex transfer produced web.

The present invention still further encompasses a noncalendered paper sheet produced by a transfer system of at least eight percent negative draw including a matrix of fibrous web material having a wet mullen burst pressure at least about 10 percent greater than a convex transfer system produced sheet. In addition, the sheet may have a wet mullen burst of at least about 74500 pascals. Moreover, the sheet may have a GMBL ranging from about 2047 to about 2704. Furthermore, the matrix of fibrous web material may be made of a mixture of fibers and at least one other fiber selected from the group consisting of wood pulp and staple fibers. Moreover, the matrix of fibrous web material may be made of a mixture of fibers and at least one particulate selected from the group consisting of activated carbon, clays, fillers, adsorbents, zeolites, superabsorbents, silica, and hydrocolloid. Additionally, the matrix of fibrous web material may be selected from the group consisting of a bonded carded web, spunbonded web, meltblown fiber web, and multi-ply fibrous web. Also, the matrix of fibrous web material may have an elmendorf tear greater than about 66.5 centinewton. Furthermore, the matrix of fibrous web material may have a tensile modulus of at least about 1544 gram per centimeter squared. Moreover, the matrix of fibrous web material may have greater strength at lower negative draw percent. Also, the matrix of fibrous web material may have greater machine direction toughness at about the same GMBL as a convex transfer produced web.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
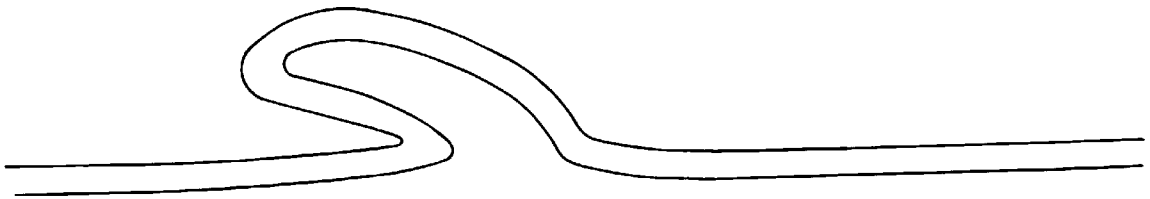
FIG. 1 is a cross-sectional representation (not to scale) of an exemplary macrofold in a paper sheet.
Figure 2:
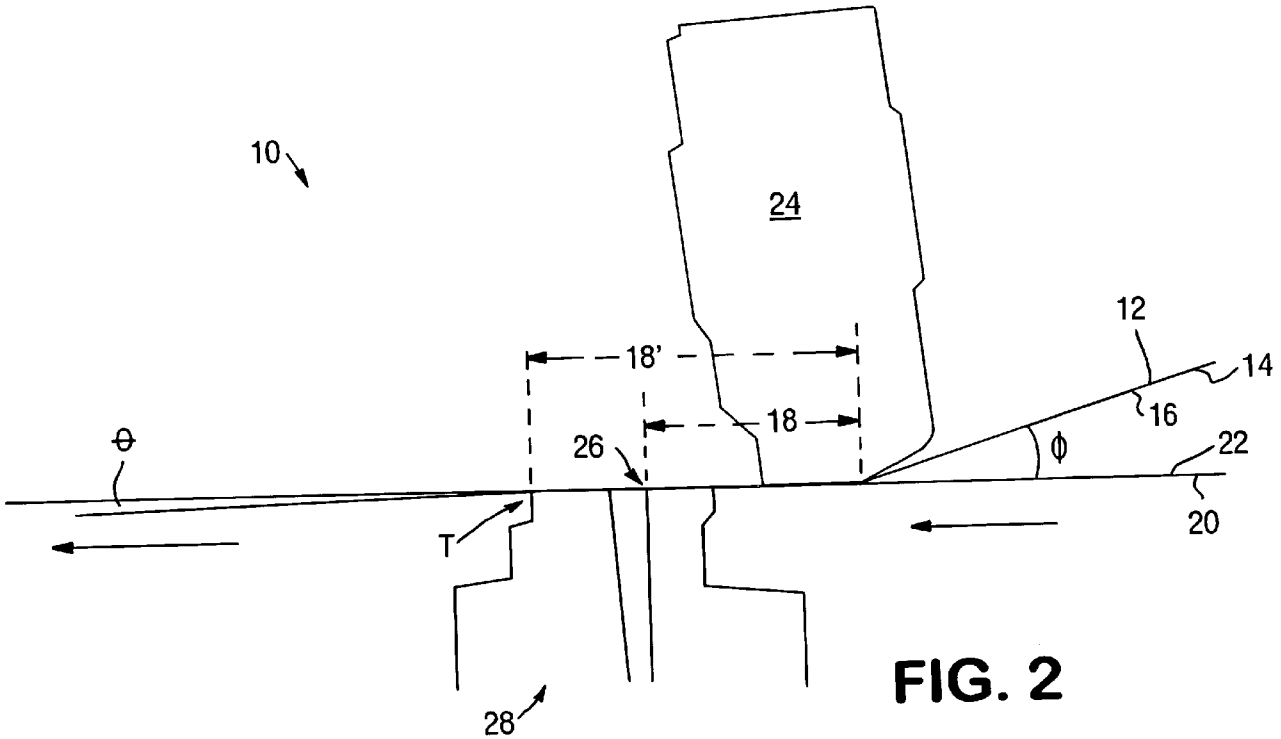
FIG. 2 is a schematic view of an exemplary improved transfer configuration.
Figure 3:
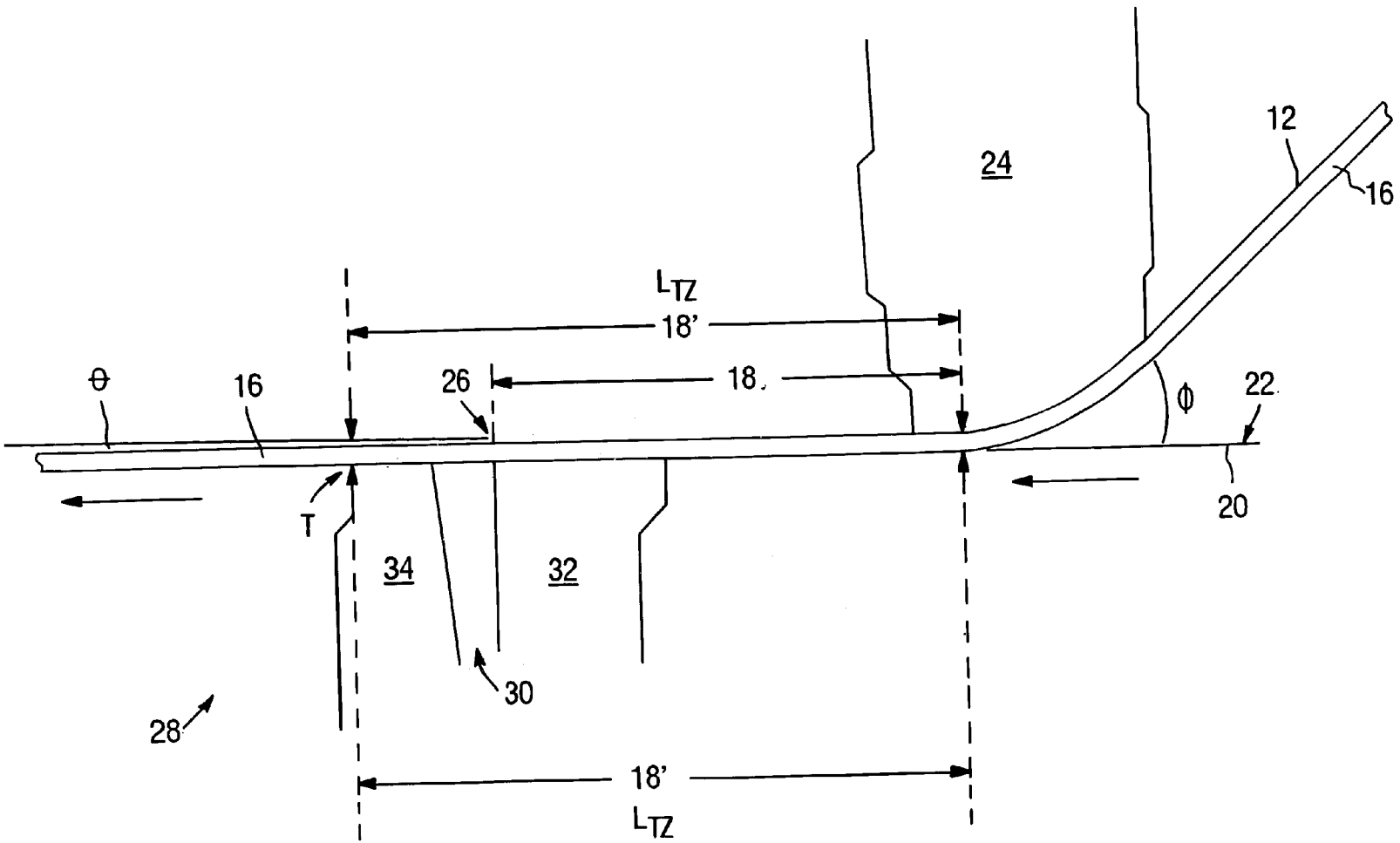
FIG. 3 is a schematic view showing in more detail certain features of an exemplary improved transfer configuration shown in FIG. 2.

Referring now to the drawings, wherein like reference numerals designate corresponding structure throughout the views, and referring in particular to FIGS. 2 and 3, there is shown (not to scale) an exemplary improved transfer configuration 10 for a paper making machine. Such an improved transfer configuration and its associated process of making fibrous webs are designed to produce in a fibrous web, at any given amount of negative draw, a greater amount of machine direction oriented extensibility or stretch than was heretofore thought possible. That is, at a specified velocity ratio between the first and second carrier fabrics, the transfer configuration and its associated process of making fibrous webs produce fibrous webs having greater machine direction extensibility than fibrous webs processed with the same carrier fabrics in differential speed transfer configurations without a lengthened transfer zone. Thus, webs having greater levels of machine direction extensibility may be achieved without macrofolding. Alternatively and/or additionally, webs having currently obtainable levels of machine direction extensibility may be achieved at a reduced risk of macrofolding thus allowing more reliable operation of such processes.

Thus, the present invention may provide improvements in levels of machine direction extensibility or machine direction stretch of from about 2.5% to about 50% or more at the same level of negative draw. For example, the improvement in machine direction extensibility or machine direction stretch may range from about 5% to about 30% or more. As another example, the improvement in machine direction extensibility or machine direction stretch may range from about 5% to about 20% or more. As yet another example, the improvement in machine direction extensibility or machine direction stretch may range from about 5% to about 15% or more. Moreover, the present invention may provide a greater total amount of machine direction extensibility or stretch than could be achieved in fibrous webs processed with the same carrier fabrics in differential speed transfer configurations without a lengthened transfer zone.

For purposes of the present invention, the term "machine direction" as used with respect to a fibrous web refers to the direction parallel to the direction of formation of a fibrous web. Generally speaking, the machine direction stretch or extensibility may be determined with conventional tensile testing equipment utilizing conventional testing techniques. For example, the machine direction stretch may be determined on equipment such as, for example, a Thwing-Albert Intellect STD2 tensile tester utilizing a one-inch wide strip of material cut so the length of the material is aligned in the machine direction. Typically, the material is conditioned at 50% relative humidity before it is mounted on the tester. The jaws of the tester are set so there is a two-inch gap and so they move apart at a rate of two inches per minute.

As mentioned previously, the term "negative draw" refers to a ratio of velocities of first and second carrier fabrics cooperating in the second transfer of a fibrous web. The negative draw may be stated as a percentage and can be calculated by the equation:

$$\text{Negative Draw}(\%)=(V_1-V_2)/\ V_1\times 100$$

where $V_1$ is the speed of the first carrier fabric and $V_2$ is the speed of the second carrier fabric.

According to an embodiment of the present invention, the improved transfer configuration includes a first carrier fabric 12 having a first surface 14 on which a fibrous web 16 is transported to a lengthened transfer zone 18 at a first velocity. The transfer configuration also includes a second carrier fabric 20 having a second surface 22 which the fibrous web 16 is transported away from the lengthened transfer zone 18 at a second velocity that is less than the first velocity.

Generally speaking, the first carrier fabric 12 may be a paper making forming fabric or other fabric used in wet formation processes. The second carrier fabric 20 may be a through-air dryer fabric, intermediate transfer fabric or other fabric useful in stages of a wet formation process following the initial forming step.

The lengthened transfer zone 18 begins at a transfer shoe 24 and terminates at a leading portion or top edge 26 of a vacuum slot 30 in a transfer head 28. The lengthened transfer zone begins at a transfer shoe and terminates at a portion of a transfer head. As noted above, it is contemplated that the lengthened transfer zone may terminate at other portions of the transfer head such as, for example, the trailing edge of the vacuum slot, the trailing edge of the transfer head or the like. For example, a lengthened transfer zone 18' is shown in FIGS. 2 and 3 as beginning at a transfer shoe and terminating at the trailing edge "T" of the transfer head 28.

The transfer shoe 24 may be a rotatable cylinder or roller (not shown) or may be a stationary chock, wedge or guide. As is evident from FIG. 3, the transfer configuration includes means for guiding the first carrier fabric 12 and the fibrous web 16 over the transfer shoe 24 so they converge with the second surface 22 of the second carrier fabric 20.

The transfer shoe should have a shape or configuration that causes the moving fabric 12 and fibrous web 16 to generate at least some centrifugal force to aid transfer of the fibrous web as the first carrier fabric 12 and fibrous web 16 converge with the second carrier fabric 20. The transfer shoe 24 may be curved, bent, angled or exhibit some other topographical change that helps generate centrifugal force in the moving carrier fabric 12 and fibrous web 16 to aid transfer. In some embodiments, the transfer shoe may be a roller or stationary cylinder.

The first carrier fabric 12 and the second carrier fabric 20 converge at an angle $\phi$. That is, angle $\phi$ is the angle between the first carrier fabric 12 and the second carrier fabric 20 just ahead of the transfer shoe. Generally speaking, the size of the first angle $\phi$ may vary depending on factors including, but not limited to, the velocity of the first carrier fabric, the consistency of the fibrous web, the composition of the fibrous web, the structure of the first carrier fabric. For example, the first angle $\phi$ may range from about 2 degrees to about 20 degrees. As another example, the first angle $\phi$ may range from about 8 degrees to about 12 degrees.

Immediately after the transfer shoe 24, the first carrier fabric and the second carrier fabric begin diverging at a second angle $\theta$ such that the distance between the first and second carrier fabrics is about equal to the thickness of the fibrous web throughout the lengthened transfer zone. In general, the fabrics may diverge at a second angle $\theta$ which may range from about 0.01 degree to about 1 degree.

According to the invention, the first and second carrier fabrics 12, 20, are desirably set up statically (i.e., prior to running the process) so they almost touch or even partially touch each other at the transfer shoe. From that point, the fabrics travel in a substantially linear, but slightly diverging, path so that during operation they each remain in contact with the fibrous web to the terminal point of the lengthened transfer zone. With this set-up, the separation or thickness between the first and second carrier fabrics may vary slightly from a minimum distance at the transfer shoe to a maximum at the termination of the lengthened transfer zone. At the terminal point, the separation or distance between the first and second carrier fabrics 12, 20 should be approximately equal to the thickness of the fibrous web.

The means for guiding the first carrier fabric 12 and the fibrous web 14 over the transfer shoe 24 so they converge and then immediately begin diverging at a slight angle includes the transfer shoe as well as any conventional conveyor or fabric guidance means commonly used with paper making or web handling equipment.

As may best be seen in FIG. 3, a fibrous web 16 is transported to a lengthened transfer zone 18 on the first surface 14 of the first carrier fabric 12, where it is transferred to the second surface 22 of the second carrier fabric 20. As also shown in FIG. 3, the lengthened transfer zone 18 is constructed and arranged to constrain the first and second carrier fabrics 12, 20 to move through the lengthened transfer zone along a substantially linear path such that the first and second surfaces 14, 22 are separated by a distance that is approximately equal to the thickness of the fibrous web at least when leaving the lengthened transfer zone. In this way, the first and second surfaces 14, 22 of the carrier fabrics are in contact with fibrous web substantially throughout the lengthened transfer zone. For example, the distance between the first and second carrier fabrics (at least when leaving the lengthened transfer zone) may range from about 0.0075 inch to about 0.0125 inch for a paper sheet having a basis weight of about 32 gram. Desirably, the distance between the first and second carrier fabrics may be ten one-thousandths of an inch (0.01") for a paper sheet having a basis weight of about 32 gram. Of course, heavier basis weight fibrous webs may require greater distance between the carrier fabrics and lower basis weight fibrous webs may require less distance between the carrier fabrics. The distance between the fibrous webs may be influenced by factors including, but not limited to, the topography of the carrier fabrics, the consistency of the fibrous web, and the composition of the fibrous web.

The present invention may be used with a variety of wet-formed fibrous webs having a variety of basis weights. Desirably, the fibrous webs are composed of pulp (e.g., paper stock) but it is contemplated that blends of pulp and other fibrous and/or particulate materials may be used. For example, the fibrous webs may include natural and synthetic fibers of various lengths, including but not limited to staple lengths. Particulate materials may be incorporated in the fibrous web and may include, but are not limited to, activated carbon, silica, hydrocolloid, clays, fillers, adsorbents, zeolites, superabsorbents and the like. The transfer configuration and process of the present invention may be used to make machine direction stretchable fibrous webs having a wide range of basis weights. For example, the basis weight of the fibrous web may range from about 8 gram to about 70 gram. As another example, the basis weight of the fibrous web may range from about 17 gram to about 50 gram. As yet another example, the basis weight of the fibrous web may range from about 32 gram to about 42 gram.

Referring to FIG. 3, the lengthened transfer zone 18 extends for a distance $L_{tz}$ in the machine direction of the paper making machine. The transfer zone length $L_{tz}$ is substantially greater than the comparable transfer length of conventional systems. Generally speaking, conventional systems seek to provide a "point contact" transfer zone. That is, conventional systems appear to be designed so the transfer zone is very small.

It is also evident from FIG. 3, that the first and second carrier fabrics are constrained so as to form a substantially linear, lengthened transfer zone. That is, second carrier fabric should pass through the lengthened transfer zone along a linear path. The first carrier fabric should also pass through the lengthened transfer zone along a linear path. In general, divergence of the first and second carrier fabrics after the transfer shoe at a slight angle which may range from about 0.01 to about 1 degree is encompassed by the expression "substantially linear". Minor variations in the path of the carrier fabrics caused by applied air pressure or vacuum to assist web transfer are also encompassed by the expression "substantially linear". Of course, the term "substantially linear" refers to such a configuration that is linear in at least one dimension or direction (e.g., the machine direction) and may also encompass a configuration that is linear in two dimensions or directions direction (e.g., the machine direction and the perpendicular or cross-machine direction).

This elongated, substantially linear transfer zone is thought to produce an increase in the amount of extensibility or stretch that is possible in the machine direction at any given level of negative draw. In fact, the amount of machine direction extensibility or stretch can be increased to a percentage amount that actually exceeds the ratio of negative draw. Desirably, $L_{tz}$ of the lengthened transfer zone 18 is within the range of about 0.75 inches to about 10 inches. For example, $L_{tz}$ may be within the range of about 2 inches to about 5 inches. In an embodiment of the invention, $L_{tz}$ may be about 3.5 inches. Although the inventors should not be held to a particular theory of operation, it is believed that the increased length of the transfer zone 18 and its substantially linear configuration creates a rearrangement of the fibers in the web prior to drying that increases its extensibility. The rearrangement of fibers prior to drying provides a fibrous web having increased bulk and extensibility without the levels of strength loss associated with conventional creping treatments. As the fibers are being rearranged, the first and second carrier fabrics are diverging or separating creating more room and providing little, if any, pressing force on the fibrous web while, at the same time, remaining in contact with the fibrous web.

The increased length of the transfer zone 18 is also thought to allow a more stable transfer of the wet fibrous web. The longer transfer zone may help distribute or diffuse various forces within the traveling fibrous web as it decelerates. This may allow less disruption of the fibers as they are reoriented in the longer transfer zone creating a sheet with high machine direction stretch and greater strength at a target level of stretch. In contrast, short transfer zones (e.g., "point contact" transfer systems) appear to concentrate various forces in the traveling fibrous web in a small area which may contribute to a greater likelihood of macrofolding and lower machine direction extensibility.

Creping requires pressing a wet fibrous web against a creping cylinder and drying the web to a point where it adheres to the creping cylinder. These steps add density to the web. The dried web is impacted on the crepe blade to foreshorten the web. This interaction with the crepe blade weakens some fiber-to-fiber bonds in the web. The resulting microfolded sheet has machine direct stretch and improved bulk but reduced strength.

In contrast, the present invention produces a sheet with good bulk in combination with strength and machine direction stretch because the sheet was never densified by pressing against a crepe cylinder or weakened by impact with a crepe blade. In contrast to conventional creping processes, desirable levels of strength are retained because the sheet consistency in the present invention is such that most of the fiber-to-fiber bonding (e.g., "paper bonding") has yet to occur when the fibers are rearranged. Fibrous webs made according to the present invention have a desirable combination of strength and machine direction stretch and may be characterized through tensile testing as Total Energy Absorbed (i.e., the total area under a plot of stress versus strain values).

The transfer configuration 10 includes a suction slot or opening in the transfer head 28 that is positioned downstream from the transfer shoe 24 to facilitate separation of the fibrous web 16 from the first surface 14 of the first carrier fabric 12. Desirably, the transfer head 28 includes an internal suction passage 30, and top and bottom lips 32, 34 respectively. The suction slot or opening is used to apply a gaseous pressure differential to complete the transfer of the fibrous web 16 from the first carrier fabric 12 to the second carrier fabric 20. The pressure differential may be in the form of an applied gas stream or a vacuum or both. The particular level of gaseous pressure differential may vary depending on factors including, but not limited to, the basis weight of the fibrous web, the consistency of the fibrous web, the type of fibers in the web, the types of carrier fabrics and treatments that may have been applied to the web prior to the transfer zone. For a given fibrous web and carrier fabrics, and in view of the disclosure provided herein, the level of gaseous pressure differential needed to achieve satisfactory transfer may be readily determined by one of skill in the art.

Experiments were carried out comparing the machine direction stretch of a fibrous web produced with an exemplary transfer configuration 10 of the present invention as described above with a fibrous web prepared in the same manner except that a conventional "point contact" transfer system. The experiments utilized the same first and second carrier fabrics for each set of comparisons. The same pulp stock was used to form a fibrous web at a basis weight of approximately 32 gram. The first carrier fabric for each example was an Asten 856 forming fabric available from Asten Wire of Appleton, Wis. The second carrier fabrics were Appleton 44GST (used with the long warp knuckle side up) and Appleton 44MST (used with the long shute knuckle side up) available from Appleton Wire Division of Appleton, Wis.

In operation, the fibrous web 16 at a consistency of about 22–28% was transported on the first surface 14 of the first carrier fabric 12 to a transfer configuration 10. Simultaneously, the second carrier fabric 20 is moved past the transfer configuration 10 at a speed that is less than the speed of the first carrier fabric 12. The difference in speed is expressed as a velocity ratio referred to as negative draw.

In the examples utilizing an exemplary lengthened transfer configuration 10 of the present invention, the first and second carrier fabrics 12, 20 were then constrained to move through the lengthened transfer zone 18 in a substantially linear path and separated by a distance approximately equal to the thickness of the fibrous web 16 so that both the first and second carrier fabrics were in contact with the fibrous web 16 through the lengthened transfer zone 18. In these examples, the basis weight of the fibrous web 16 was approximately 32 gram and the distance between the first and second carrier fabrics was approximately ten one-thousandths of an inch (0.01").

Figure 4:
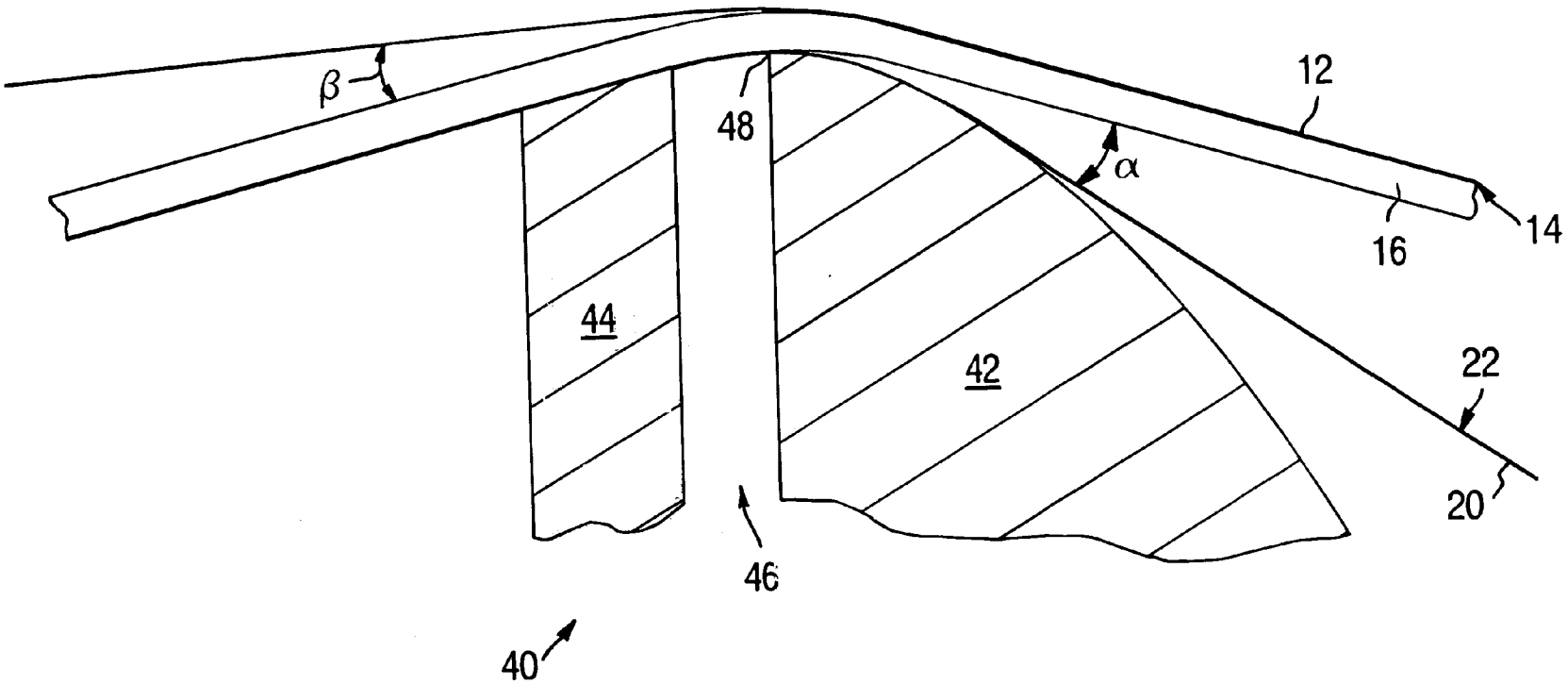
FIG. 4 is a schematic view of an exemplary "point contact" transfer configuration.

In examples utilizing the conventional "point contact" transfer configuration, the fibrous web was transferred by having both the first and second carrier fabrics "wrap" a partially curved transfer head. FIG. 4 is an illustration of such an exemplary conventional "point contact" transfer system. A first carrier fabric 12 having a first surface 14 on which is transported a fibrous web 16 converges with a second carrier fabric 20 having a second surface 22. The two fabrics converge at an angle $\alpha$ of about 3 degrees before contacting a partially curved transfer head 40 having a top lip 42 and a bottom lip 44 separated by a vacuum slot 46. The top lip 42 is curved, having an eight-inch radius. The bottom lip 44 is flat and is aligned at an angle so that the surface of the transfer shoe 40 from the front 48 of the vacuum slot 46 to the trailing end 50 of the bottom lip 44 falls away from the "point contact." More particularly, the bottom lip 44 is aligned at an angle of about 2.5 degrees from a line tangent to the front 48 of the vacuum slot 46.

The second carrier fabric 20 wraps the top lip 42 for a short distance (about 0.25 inch) before reaching the vacuum slot 46. The first carrier fabric 12 and the fibrous web 16 converge with the second carrier fabric 20 at the transfer head 40 just before the front 48 of the vacuum slot 46. The fibrous web 16 sandwiched between the first and second carrier fabrics 12, 20 pass over the vacuum slot 46 and immediately begin to diverge. At this point, the fibrous web 16 is transferred to second surface 22 of the second carrier fabric 20 and the first and second carrier fabrics 12, 20 diverge at an angle β of about 0.2 degrees (not to scale).

In each set of examples, the webs immediately passed to a through air dryer after exiting the transfer configuration.

The machine direction extensibility or machine direction stretch was measured utilizing a Thwing-Albert Intellect STD2 tensile test equipment with conventional software set for a one inch wide strip of material (oriented with the length in the machine direction), a two-inch gap between the test jaws and a cross-head speed of 2 inches per minute.

Figure 5:
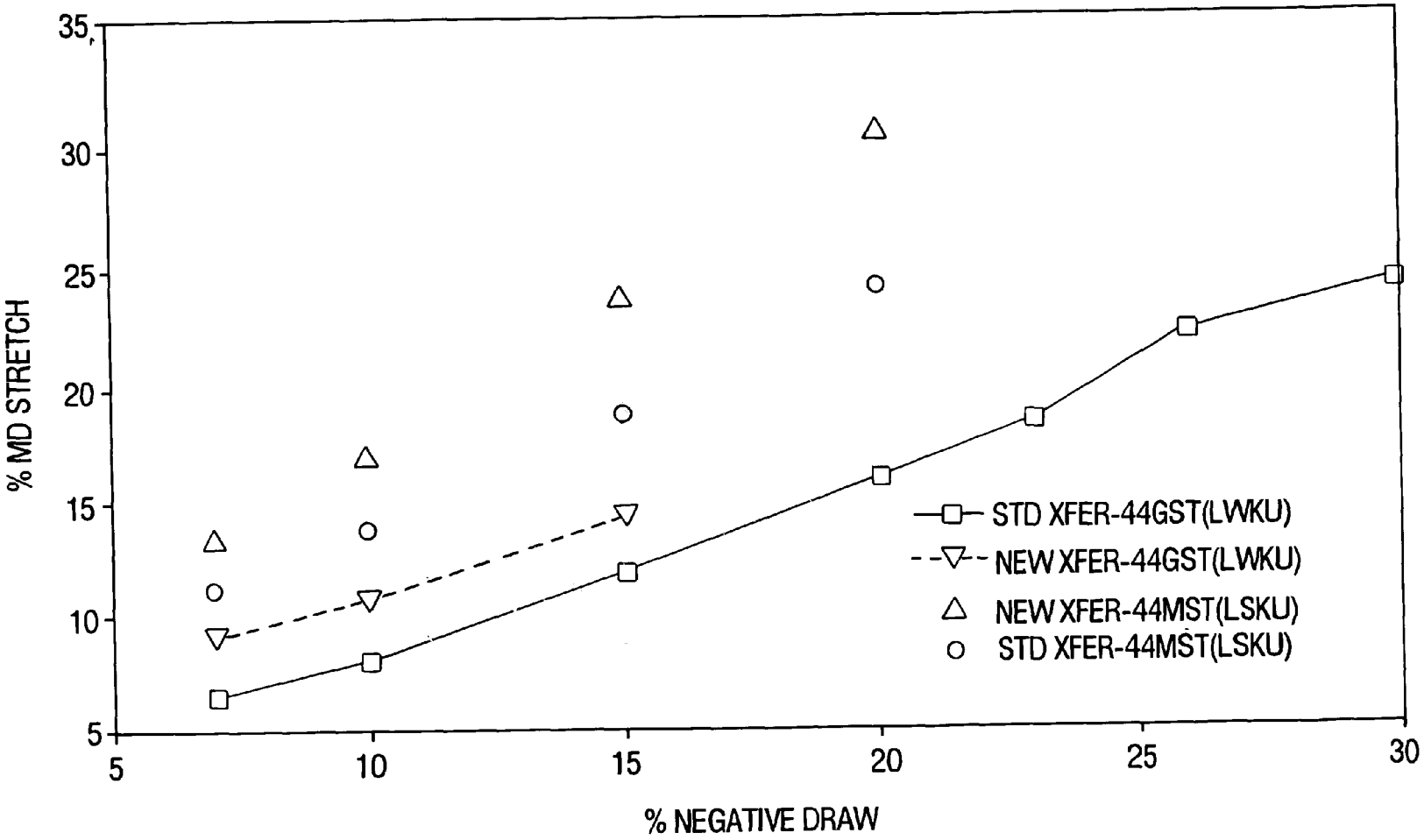
FIG. 5 is a graphical depiction of machine direction stretch versus negative draw for samples that were produced with an exemplary improved transfer configuration versus samples that were produced with an exemplary "convex" or "point contact" transfer configuration.

FIG. 5 is a graphical representation of the results of the experiments conducted to measure the performance of the transfer system of the present invention as described above with the "point contact" transfer system depicted in FIG. 4. FIG. 5 shows a plot of machine direction stretch (in percent) versus negative draw for the Appleton 44GST and Appleton 44MST fabrics used in the new transfer system and the "point contact" transfer system described above. In each case, the new transfer yielded greater machine direction stretch at a given rate or amount of negative draw.

Additional experiments carried out compared samples from sheets prepared by the transfer process of the present invention (hereinafter referred to as "straight transfer") versus samples from sheets prepared by the conventional "convex" or "point contact" transfer configuration (hereinafter referred to as "convex transfer"). Pulp stock including about 44 percent mobile wet lap pine, about 44 percent OWENSBORO recycled fiber, and about 12 percent mobile wet lap hard wood formed the fibrous web run through both transfer systems. During the straight transfer runs, the mobile pulp was refined at 0.5 horsepower-days/ton. Afterwards, the entire furnish was refined with a machine tickler refiner at 0.2 to 0.6 horsepower-days/ton, which was then run with added kymene at 11.5 pounds/ton and 4 pounds per ton of carboxy methyl cellulose dry strength resin. The first carrier fabric 12 utilized with each transfer system was Asten 866B forming fabric available from Asten Wire of Appleton, Wis. The second carrier fabric 20 used for each system was Albany 44GST from Appleton Wire Division of Appleton, Wis. The two transfer systems were run with similar furnish and machine parameters.

In operation, the first carrier fabric 12 moves at a speed greater than the second carrier fabric 20. The speeds of the carriers may be varied, thereby varying the speed ratio of the two carriers. This ratio may be expressed as a percent negative draw as previously described.

Fibrous web sheets were created on both the transfer configurations at varying negative draw percent. Several experiments were run on the samples from these sheets. Each data point depicted on the FIGS. 6–11 represents the mean of seven samples cut from a section extending in the cross direction of a sheet. All samples tested had a thickness of about 0.045 centimeters.

Figure 6:
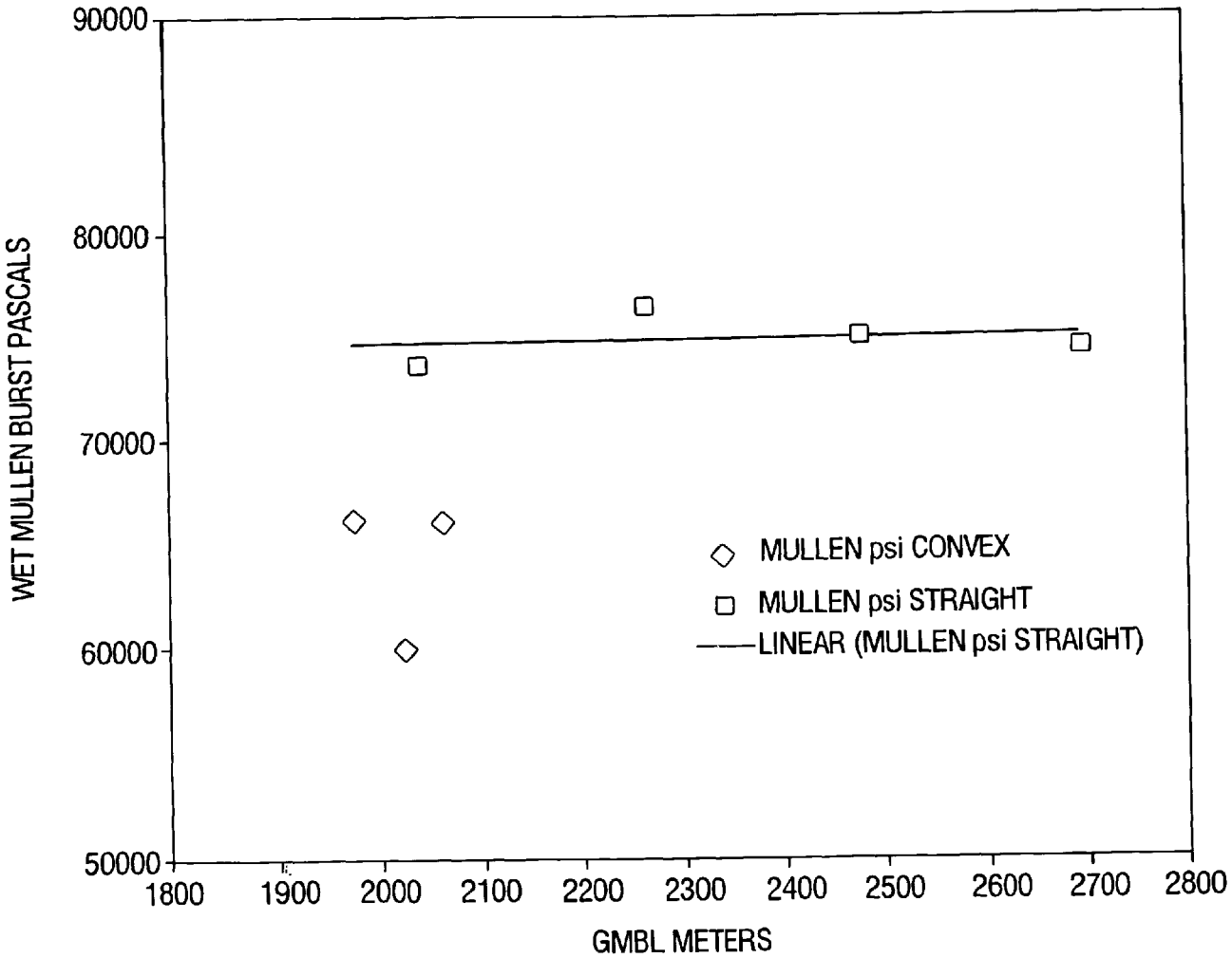
FIG. 6 is a graphical depiction of wet mullen bursting pressure reported by pascal versus geometric mean breaking length reported by meter for samples that were produced with an exemplary improved transfer configuration versus samples that were produced with an exemplary "convex" or "point contact" transfer configuration.
Figure 7:
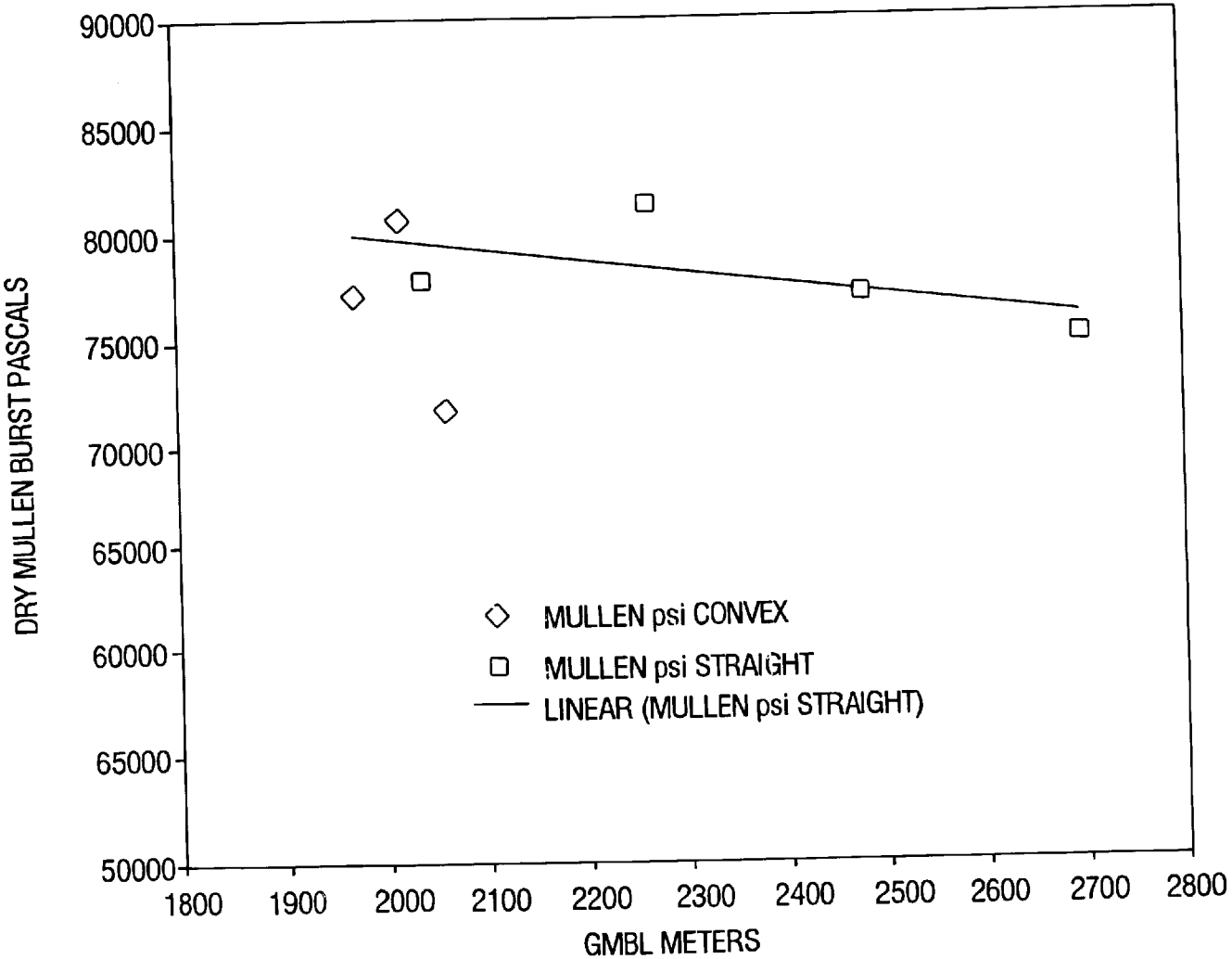
FIG. 7 is a graphical depiction of dry mullen bursting pressure reported by pascal versus geometric mean breaking length reported by meter for samples that were produced with an exemplary improved transfer configuration versus samples that were produced with an exemplary "convex" or "point contact" transfer configuration.

FIGS. 6 and 7 represent data taken by running the respective wet mullen burst and dry mullen burst tests. These test measure the toughness of a material by inflating the material with a diaphragm until it ruptures. These tests may be undertaken utilizing conventional testing equipment and techniques. These tests were conducted utilizing a Mullen Burst Strength Tester, such as those manufactured by B. F. Perkins & Son Inc., whose address is GPO 366, Chicopee, Mass. 01021 or Testing Machines Inc., whose address is 400 Bayview Avenue, Amityville, N.Y. 11701. The test procedure included clamping about a sample having a length and width of about 12.7 centimeter above a rubber diaphragm, inflating the diaphragm by pressure generated by forcing liquid into a chamber at about 95 milliliters per minute, and recording the pressure at which the sample ruptures. The rupture pressure was reported in pascals.

The wet mullen burst procedure further included saturating the sample with purified water and blotting the excess prior to clamping into the apparatus. FIG. 6 is a graphical representation of the data presented in Table 1.

TABLE 1

| GMBL meters | Negative Draw Percent | Burst Pressure of Straight Transfer pascals | Burst Pressure of Convex Transfer pascals |
|---|---|---|---|
| 2066 | 12 | | 66200 |
| 2026 | 15 | | 60000 |
| 1979 | 15 | | 66200 |
| 2074 | 8.3 | 74500 | |
| 2487 | 12 | 75200 | |
| 2273 | 15 | 76500 | |
| 2047 | 20 | 73800 | |

As depicted in FIG. 6, the sheets formed by the straight transfer process exhibit a higher burst pressure at all negative draw percents as compared to the sheets formed by the convex transfer. Accordingly, the sheets formed by the straight transfer have a greater overall toughness when wet than the sheets formed by the convex transfer process.

Conversely, the dry mullen burst samples were not saturated with water, but were conditioned for approximately 12 hours at 23 degrees Centigrade at 50% relative humidity prior to testing. FIG. 7 is a graphical representation of the data presented in Table 2.

TABLE 2

| GMBL meters | Negative Draw Percent | Burst Pressure of Straight Transfer pascals | Burst Pressure of Convex Transfer pascals |
|---|---|---|---|
| 2066 | 12 | | 71700 |
| 2026 | 15 | | 80700 |
| 1979 | 15 | | 77200 |
| 2704 | 8.3 | 75200 | |
| 2487 | 12 | 77200 | |
| 2273 | 15 | 81400 | |
| 2047 | 20 | 77900 | |

As depicted in FIG. 7, the sheets formed by the straight transfer process exhibit approximately the same burst pressure at all negative draw percents as compared to the sheets formed by the convex transfer. Consequently, the increased bursting pressure for the wet sheets is unexpected.

Figure 8:
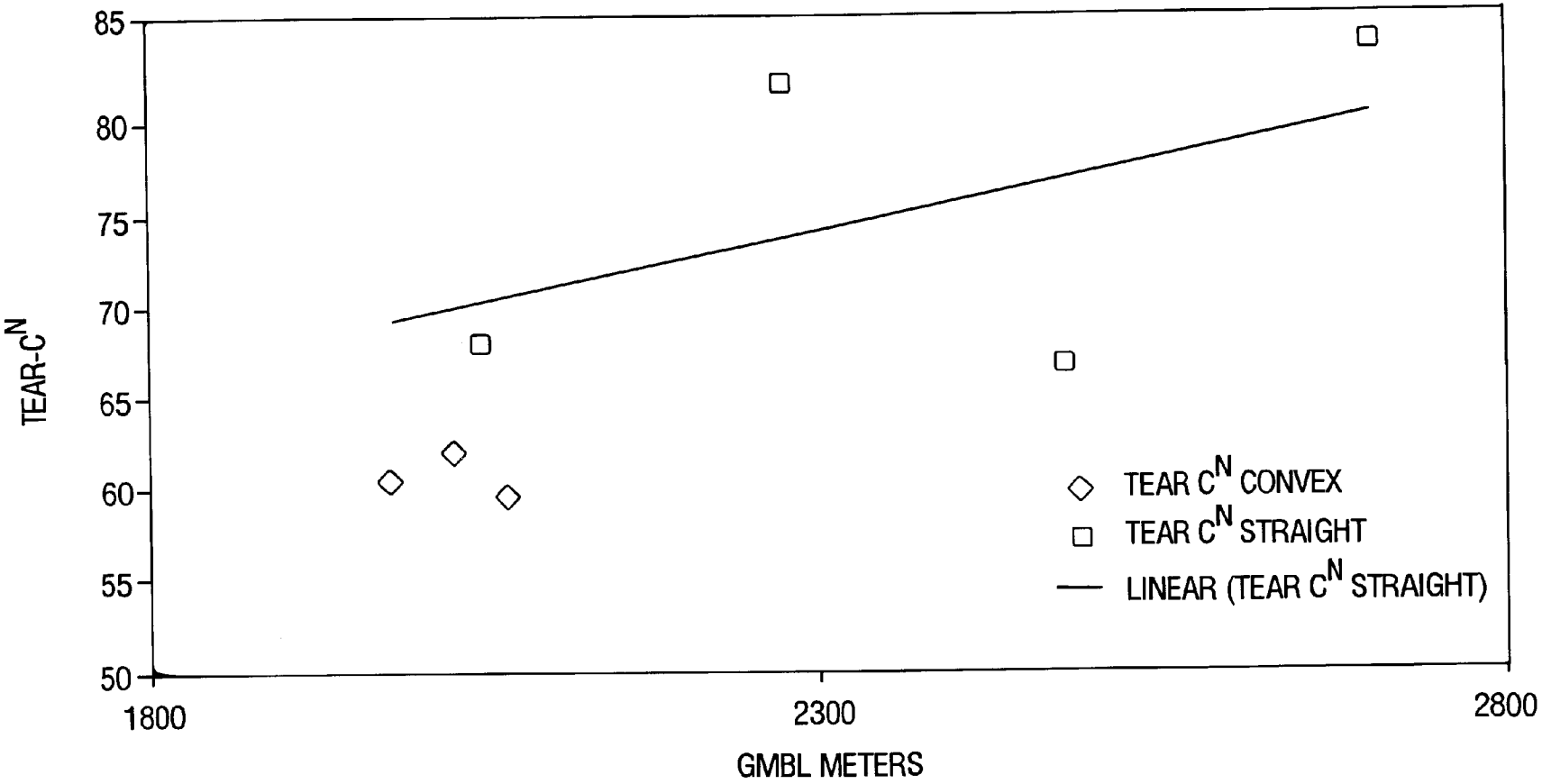
FIG. 8 is a graphical depiction of tear reported by centinewton versus geometric mean breaking length reported by meter for samples that were produced with an exemplary improved transfer configuration versus samples that were produced with an exemplary "convex" or "point contact" transfer configuration.

FIG. 8 represents data taken by running the elmendorf tear test. This test measures the toughness of a material by measuring the work required to propagate a tear when part of the sample is held in a clamp and an adjacent part is moved by the force of a pendulum freely falling in an arc. This test may be undertaken utilizing conventional testing equipment and techniques. This test was conducted utilizing a TEXTEST FX 3700 manufactured by Schmid Corporation of Spartanburg, S.C. 29304. The test procedure included clamping eight plies of fibrous web sample, cutting a notch through the plies in the machine direction leaving about 6.3 centimeters uncut, and swinging a pendulum through the plies, thereby completely tearing them. Each ply was about 10.16 centimeters long, about 6.35 centimeters wide, and about 0.045 centimeters thick. The pendulum weight was adjusted to its mid potential energy range. The tear energy was recorded in centinewtons. FIG. 8 is a graphical representation of the data presented in Table 3.

TABLE 3

| GMBL meters | Negative Draw Percent | Tear Energy Straight Transfer centinewton | Tear Energy Convex Transfer centinewton |
|---|---|---|---|
| 2066 | 12 | | 59.6 |
| 2026 | 15 | | 62.2 |
| 1979 | 15 | | 60.6 |
| 2704 | 8.3 | 83.7 | |
| 2487 | 12 | 66.5 | |
| 2273 | 15 | 82.1 | |
| 2047 | 20 | 68.3 | |

As depicted in FIG. 8, the sheets formed by the straight transfer process exhibit a higher tear energy at all negative draws as compared to the sheets formed by the convex transfer. Accordingly, the sheets formed by the straight transfer have a greater overall toughness with regard to tear resistance than the sheets formed by the convex transfer process.

Figure 9:
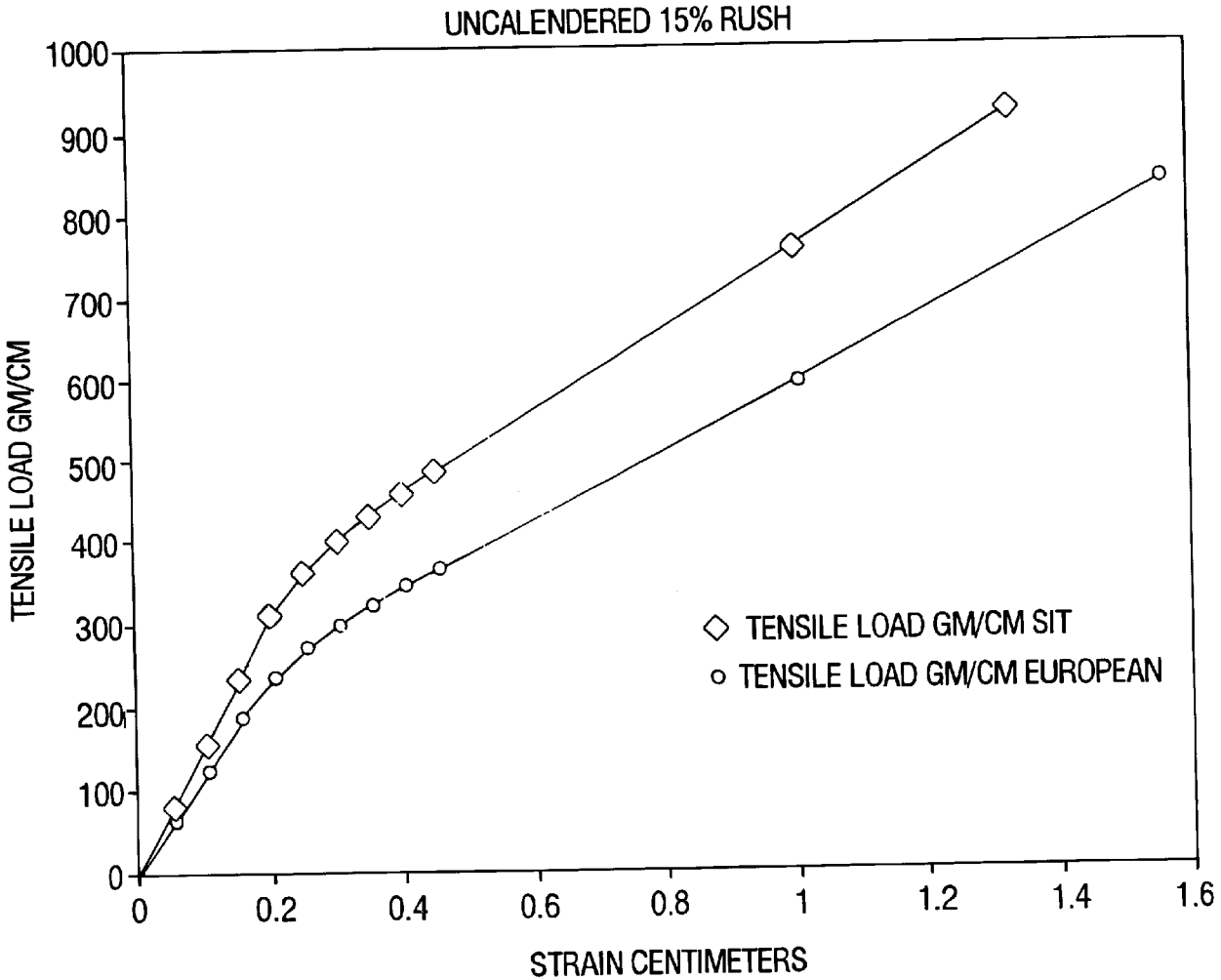
FIG. 9 is a graphical depiction of tensile load reported by gram per centimeter versus strain reported by centimeter for samples that were produced with an exemplary improved transfer configuration versus samples that were produced with an exemplary "convex" or "point contact" transfer configuration.
Figure 10:
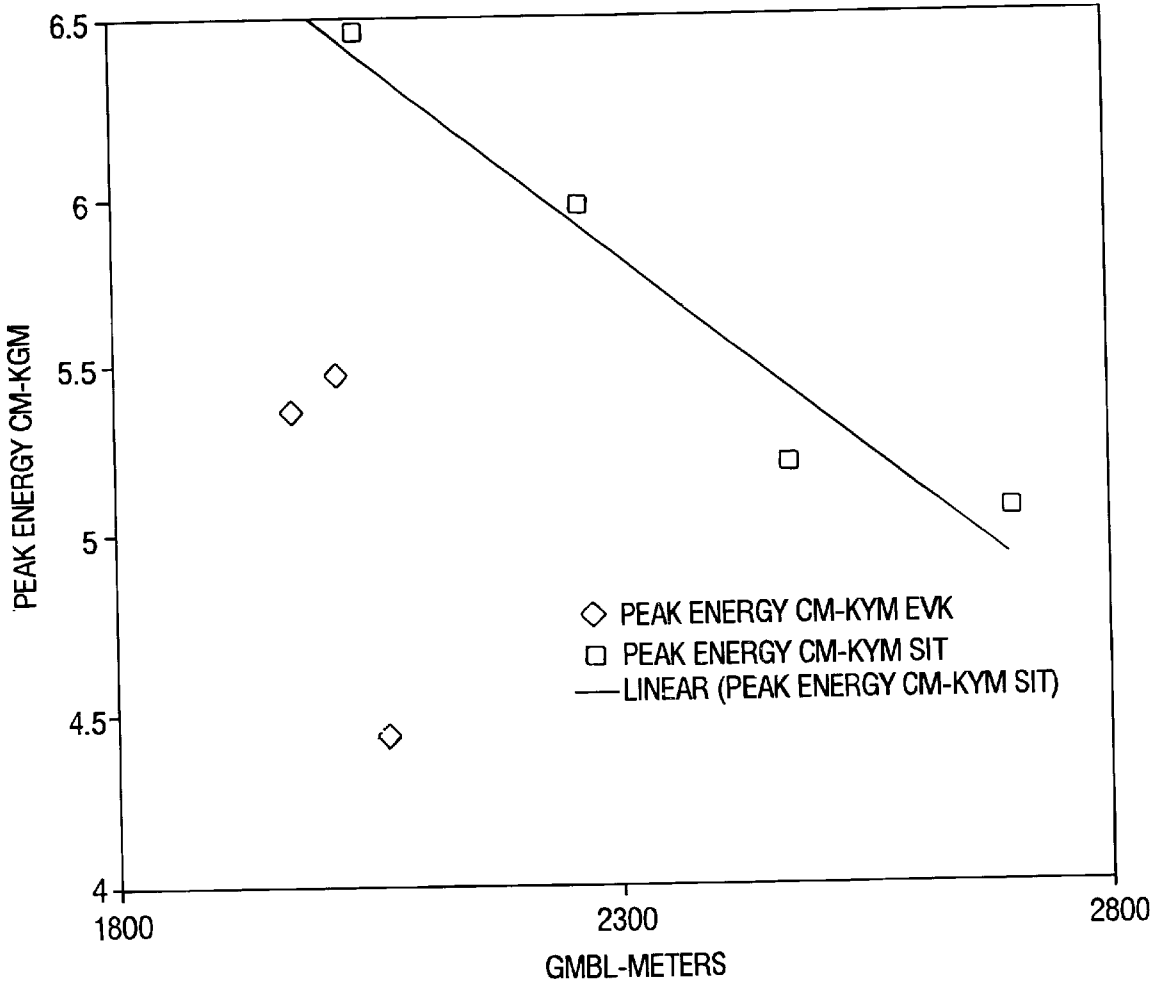
FIG. 10 is a graphical depiction of peak energy reported by centimeter times kilogram times meter divided by seconds squared versus geometric mean breaking length reported by meter for samples that were produced with an exemplary improved transfer configuration versus samples that were produced with an exemplary "convex" or "point contact" transfer configuration.
Figure 11:
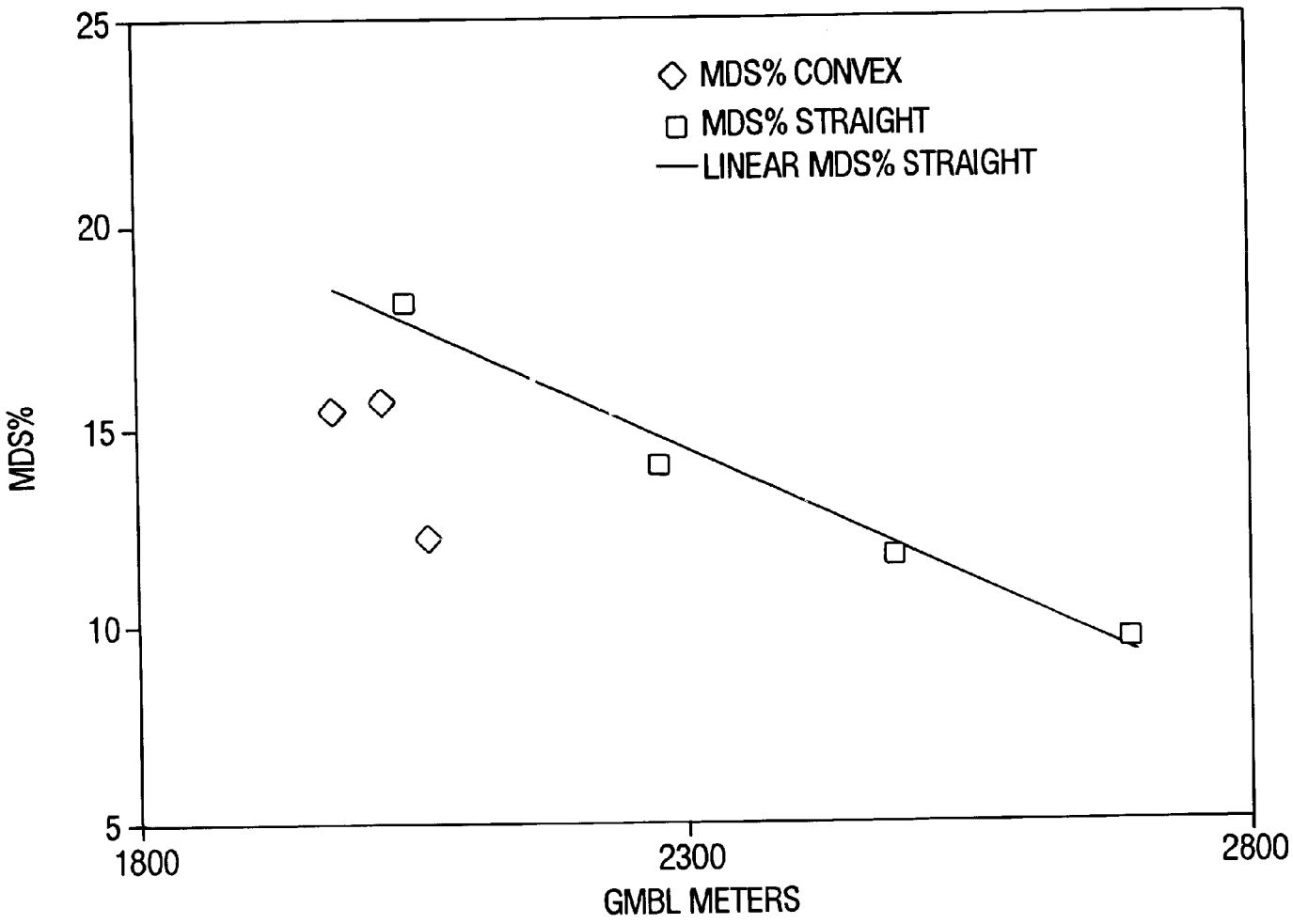
FIG. 11 is a graphical depiction of machine direction stretch reported by percent versus geometric mean breaking length reported by meter for samples that were produced with an exemplary improved transfer configuration versus samples that were produced with an exemplary "convex" or "point contact" transfer configuration.

FIGS. 9, 10, and 11 represent data acquired by running the tensile strength and stretch test. This test measures the machine direction toughness of a material by pulling at a constant extension rate until the material breaks. This test may be undertaken utilizing conventional testing equipment and techniques. This test was conducted utilizing a SINTECH 2 tensile tester manufactured by Sintech Corporation, whose address is 1001 Sheldon Drive, Cary, N.C. 27513. The test procedure included securing a sample at either end in the cross direction with about 10.16 centimeter clamps and stretching at a rate of about 25.40 centimeter per minute until the sample breaks. Each sample had a machine direction length of about 15.24 centimeters and a cross direction width of about 7.62 centimeters. This testing procedure obtained data regarding tensile load versus strain.

FIG. 9 is a graphical representation of the data presented in Table 4.

TABLE 4

| Strain Centimeter | Negative Draw Percent | Tensile Load Straight Transfer gram per centimeter | Tensile Load Convex Transfer gram per centimeter |
|---|---|---|---|
| 0.0000 | 15 | 0.0 | 0.0 |
| 0.0508 | 15 | 78.4 | 62.7 |
| 0.1016 | 15 | 156.9 | 125.6 |
| 0.1524 | 15 | 235.3 | 188.4 |
| 0.2032 | 15 | 313.7 | 238.0 |
| 0.2540 | 15 | 365.0 | 275.5 |
| 0.3048 | 15 | 400.0 | 301.8 |
| 0.3556 | 15 | 433.0 | 325.0 |
| 0.4064 | 15 | 459.2 | 350.0 |
| 0.4572 | 15 | 485.0 | 367.4 |
| 1.0160 | 15 | 754.4 | 593.0 |
| 1.3462 | 15 | 918.4 | |
| 1.5748 | 15 | | 833.1 |

As depicted in FIG. 9, the sheets formed by the straight transfer process exhibit a greater initial slope at fifteen percent negative draw as compared to the sheets formed by the convex transfer. This slope may be referred to as a tensile modulus and is measured in the elastic range of the samples. The straight transfer sample has a tensile modulus of 1544 gram per square centimeter versus 1236 gram per square centimeter for the convex transfer. Accordingly, the sheets formed by the straight transfer have a greater machine direction toughness with regard to tensile modulus at fifteen percent negative draw than the sheets formed by the convex transfer process.

FIG. 10 is a graphical representation of the data presented in Table 5.

TABLE 5

| GMBL Meters | Negative Draw Percent | Peak Energy Convex Transfer (centimeters*kg*m) | Peak Energy Straight Transfer (centimeters*kg*m) |
|---|---|---|---|
| 2066 | 12 | 4.436 | |
| 2026 | 15 | 5.484 | |
| 1979 | 15 | 5.380 | |
| 2704 | 8.3 | | 5.070 |

A depicted in FIG. 10, the sheet formed by the straight transfer process exhibit greater machine direction toughness and lower strenght at higher negative draws. This characteristic of the straight transfer sheets permits creating a sheet with less strenght, but greater toughness. A sheet with less strenght tends to provide a material with a softer feel.

FIG. 11 is a graphical representation of the data presented in Table 6.

TABLE 6

| GMBL meters | Negative Draw Percent | Machine Direction Stretch Straight Transfer Percent Stretch | Machine Direction Stretch Convex Transfer Percent Stretch |
|---|---|---|---|
| 2066 | 12 | | 12.1 |
| 2026 | 15 | | 15.5 |
| 1979 | 15 | | 15.3 |
| 2704 | 8.3 | 9.1 | |
| 2487 | 12 | 11.1 | |
| 2273 | 15 | 3.9 | |
| 2047 | 20 | 17.9 | |

As depicted in FIG. 11, the sheets formed by the straight transfer process exhibit higher machine direction stretch at about the same GMBL as compared to sheets formed by the convex transfer process. This indicates a tougher sheet allowing lower strength to obtain the same functional utility.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A sheet material comprising a matrix of fibers consisting of fibrous cellulosic material wherein the sheet material has the following properties:

geometric mean breaking length between about 2047 and about 2704 meters, wet mullen burst between about 73,800 and about 76,500 pascals, dry mullen burst between about 75,200 and about 81,400 pascals, elmendorf tear energy between about 66.5 and about 83.7 centinewtons, tensile modulus greater than about 1236 gram per square centimeter, peak energy between about 5.070 and about 6.455 centimeter-kilogram-meter, and, machine direction stretch between about 9.1 and about 17.9 percent.

2. The sheet material of claim 1 further comprising at least one particulate selected from the group consisting of activated carbon, clays, fillers, adsorbents, zeolites, superabsorbents, silica, and hydrocolloid.

3. The sheet material of claim 1 further comprising a dry strength agent.

4. The sheet material of claim 1 further comprising a wet strength agent.

5. A sheet material comprising a matrix of fibers consisting of fibrous cellulosic material wherein the sheet material has the following properties:

geometric mean breaking length between about 2047 meters and about 2704 meters, machine direction stretch greater than about 10 percent, and an elmendorf tear energy between about 66.5 and about 83.7 centinewtons.

6. The sheet material of claim 5 wherein the sheet material has a dry mullen burst greater than about 70000 pascals.

7. The sheet material of claim 5 wherein the sheet material has a wet mullen burst greater than about 70000 pascals.

8. The sheet material of claim 5 further comprising a dry strength agent.

9. The sheet material of claim 5 further comprising a wet strength agent.

10. The sheet material of claim 5 further comprising at least one particulate selected from the group consisting of activated carbon, clays, fillers, adsorbents, zeolites, superabsorbents, silica, and hydrocolloid.

11. A sheet material comprising a matrix of fibers consisting of fibrous cellulosic material wherein the sheet material has the following properties:

geometric mean breaking length between about 2047 meters and about 2704 meters, machine direction stretch greater than about 10 percent, and elmendorf tear energy between about 66.5 and about 83.7 centinewtons.

12. The sheet material of claim 11 wherein the sheet material has a wet mullen burst greater than about 70000 pascals.

13. The sheet material of claim 11 wherein the sheet material has a dry mullen burst greater than about 70000 pascals.

14. The sheet material of claim 11 further comprising a dry strength agent.

15. The sheet material of claim 11 further comprising a wet strength agent.

16. The sheet material of claim 11 further comprising at least one particulate selected from the group consisting of activated carbon, clays, fillers, adsorbents, zeolites, superabsorbents, silica, and hydrocolloid.

17. A sheet material comprising a matrix of fibers consisting of fibrous cellulosic material wherein the sheet material has the following properties:

geometric mean breaking length between about 2047 meters and about 2704 meters, machine direction stretch greater than about 10 percent, elmendorf tear energy between about 66.5 and about 83.7 centinewtons, dry mullen burst greater than about 70000 pascals, and wet mullen burst greater than about 70000 pascals.

18. The sheet material of claim 17 further comprising a dry strength agent.

19. The sheet material of claim 17 further comprising a wet strength agent.

20. The sheet material of claim 17 further comprising at least one particulate selected from the group consisting of activated carbon, clays, fillers, adsorbents, zeolites, superabsorbents, silica, and hydrocolloid.

* * * * *